US006621078B2

(12) United States Patent
Taniguchi et al.

(10) Patent No.: US 6,621,078 B2
(45) Date of Patent: Sep. 16, 2003

(54) ION TRAPPING DEVICE

(75) Inventors: Junichi Taniguchi, Kyoto (JP); Eizo Kawato, Kyoto-fu (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 10/166,773

(22) Filed: Jun. 12, 2002

(65) Prior Publication Data

US 2002/0190206 A1 Dec. 19, 2002

(30) Foreign Application Priority Data

Jun. 13, 2001 (JP) ..... 2001-178165

(51) Int. Cl.[7] ..... H01J 49/30

(52) U.S. Cl. ..... 250/292; 250/287; 250/282; 250/252.1; 250/298

(58) Field of Search ..... 250/292, 287, 250/282, 252.1, 298

(56) References Cited

U.S. PATENT DOCUMENTS 6,124,592 A * 9/2000 Spangler ..... 250/287
6,194,716 B1 * 2/2001 Takada et al. ..... 250/292
6,541,766 B2 * 4/2003 Kato ..... 250/282

OTHER PUBLICATIONS

US publication No.: US 2002/0008199 A1, "Apparatus for Mass Spectrometry on Ion–Trap Method" by Yoshinari et al., publication date: Jan. 24, 2002.*

* cited by examiner

*Primary Examiner*—John R. Lee
*Assistant Examiner*—Zia R. Hashmi
(74) *Attorney, Agent, or Firm*—Armstrong, Westerman & Hattori, LLP

(57) ABSTRACT

When ions are introduced from outside into the ion trap space, a static electric field having equi-voltage surfaces concave to the entrance hole is formed in the ion trap space. For ions obliquely entering the ion trap space, such a static electric field makes the ions cross the equi-voltage surfaces at almost perpendicular angles. Owing to such configuration, ions are effectively decelerated, and enough time can be secured until ions of larger mass-to-charge ratios assuredly enter the ion trap space.

8 Claims, 2 Drawing Sheets

ION TRAPPING DEVICE

The present invention relates to an ion trapping device used for a mass filter, mass-spectrometer or other purposes. It especially relates to such a type of ion trapping device that ions generated outside of the ion trapping device are introduced into it and trapped inside.

FIG. 3 shows a typical ion trap mass spectrometer, which is composed of an ion trapping device and an ion detector 9. The ion trapping device includes a ring electrode 2 and two end cap electrodes 3, 4. The first end cap electrode 3 and the second end cap electrode 4 are placed just opposite each other with the ring electrode 2 between them. The ring electrode 2 has a hyperboloid-of-one-sheet-of-revolution internal surface, and the end cap electrodes 3, 4 have hyperboloid-of-two-sheets-of-revolution internal surfaces. At about the center of the first end cap electrode 3, an entrance hole 5 for letting thermal electrons or ions in is provided. Thus the first end cap electrode 3 is called an entrance end cap electrode. In the second end cap electrode 4, an exit hole 6 is formed for ejecting ions. The exit hole 6 is aligned in line with the entrance hole 5. Thus the second end cap electrode 4 is called an exit end cap electrode. The ion detector 9 is placed just outside of the exit hole 6.

When ions of a sample are to be generated in the inside space 1 of the ion trapping device (the space is then called an "ion trap space"), molecules of the sample are introduced into the ion trap space 1 from outside through a sample inlet 8, and electrons generated by a thermal electron generator 7 placed outside of the entrance hole 5 are also introduced into the ion trap space 1. Owing to the thermal electrons, the sample molecules are ionized in the ion trap space 1. By applying appropriate voltages to the ring electrode 2 and the end cap electrodes 3, 4, a quadrupole electric field is generated and the ions are contained, or trapped in the ion trap space 1. Ions are thus trapped in the ion trap space 1, normally, while a radio frequency (RF) voltage of about 1 MHz is applied to the ring electrode 2, and the voltages to the end cap electrodes 3, 4. are kept at about zero. If the RF voltage applied to the ring electrode 2 is scanned, in an appropriate manner while the ions are trapped in the ion trap space 1, ions having a mass-to-charge ratio corresponding to the RF voltage are ejected from the exit hole 6. The ions are detected by the ion detector 9, and the detected signal is then processed to construct a mass spectrum. In some cases, the ions ejected from the ion trap space 1 are introduced to another mass spectrometer, a time-of-flight (TOF) mass spectrometer, for example, and a more precise mass-to-charge ratio measurement may be made.

When the ion trap mass spectrometer is used as a detector of a liquid chromatograph, the liquid sample should be vaporized or the solvent should be eliminated. Such vaporization or de-solvent process requires an appropriate interface. In such a case, the ionization is not performed within the ion trap space 1, but the sample is instead ionized in an outside ion source and the ions are introduced in the ion trap space 1 through the entrance hole 5.

In conventional ion trap mass spectrometers (for example, that described in WO99/39370), the entrance end cap electrode 3 and the ring electrode 2 are applied with the ground voltage (normally, zero voltage) and the exit end cap electrode 4 is applied with a positive voltage if positive ions are to be introduced in the ion trap space 1 from outside. These voltages produce a static electric field for decelerating ions in the ion trap space 1.

FIG. 4 illustrates the equi-voltage surfaces of the static electric field produced in the ion trap space 1 by the voltages applied to the electrodes 2–4, as described above. FIG. 4 is drawn by computer simulation. Among various ions generated in the external ion source (not shown), ions having relatively smaller mass-to-charge ratios first enter the ion trap space 1 through the entrance hole 5. Such ions are decelerated by the static electric field as shown in FIG. 4 and are bounced back, so that they are prevented from colliding with the exit end cap electrode 4. In the meantime, ions having relatively larger mass-to-charge ratios arrive at the entrance hole 5 and are introduced in the ion trap space 1. When all the object ions, including ions having relatively larger mass-to-charge ratios, enter the ion trap space 1, the voltage applied to the exit end cap electrode 4 is changed to the ground voltage and, at about the same time, the RF voltage applied to the ring electrode 2 is increased sharply. Thus all the ions within the ion trap space 1 are assuredly trapped in it.

When such a decelerating static electric field is produced by applying the voltage to the exit end cap electrode 4, the following problem arises. As shown in FIG. 4, the static electric field has equi-voltage surfaces convex to the incoming ions. In such a configuration, ions coming through the entrance hole 5 almost straight along the axis C into the ion trap space 1 cross substantially perpendicularly to the equi-voltage surfaces. Such ions are properly decelerated. But ions traveling obliquely to the axis C cross the equi-voltage surfaces at an angle. Such ions are not properly decelerated. When the voltage to the exit end cap electrode 4 is changed to the ground voltage, the energy of the ions are not adequately decreased. And the ions are directed to the ring electrode 2, so that the ions collide with the ring electrode 2 before ions of relatively larger mass-to-charge ratios come in. These make it difficult to broaden the range of mass-to-charge ratio of the ions trapped in the ion trap space 1.

In summary, by the conventional method, the ion trapping efficiency, especially the trapping efficiency of ions of relatively smaller mass-to-charge ratios, was not high.

The present invention addresses the problem; one of its objectives is to provide an ion trapping device having a larger trapping efficiency, therefore providing higher sensitivity when it is used in mass analyses.

SUMMARY OF THE INVENTION

The problem is solved in the ion trapping device of the present invention as follows. When ions are introduced from outside into the ion trap space, a static electric field having equi-voltage surfaces concave to the entrance hole 5 is formed in the ion trap space as shown in FIG. 2. Even for ions obliquely entering the ion trap space, such a static electric field makes the ions cross the equi-voltage surfaces at near perpendicular angles. Owing to such a configuration, ions are effectively decelerated, and enough time can be secured until later ions thoroughly enter the ion trap space.

Thus, an ion trapping device according to the present invention includes:

a ring electrode;

an entrance end cap electrode and an exit end cap electrode placed opposite each other with the ring electrode between them, wherein the ring electrode, the entrance end cap electrode and the exit end cap electrode form an ion trap space surrounded by them, and the entrance end cap electrode has an entrance hole for introducing ions from outside to the ion trap space; and a voltage controller for applying preset respective voltages to the ring electrode, the entrance end cap electrode and the exit end cap electrode to form equi-voltage surfaces in the ion trap space which are concave to the entrance hole.

In a form of the present invention, the voltage controller applies the same first direct current (DC) voltage to the ring electrode and the exit end cap electrode, and applies the second DC voltage which is lower than the first DC voltage if the ions are positive, or is higher than the first DC voltage if the ions are negative, to the entrance end cap electrode.

Preferably, the voltage controller applies the second DC voltage to the entrance end cap electrode while ions are being introduced in the ion trap space, and, subsequently, at a predetermined timing, changes the voltage to the entrance end cap electrode to a zero or near-zero voltage. The timing is predetermined so that ions of a preset end of larger mass-to-charge ratios are thoroughly introduced into the ion trap space. Thus the timing depends on the range of mass-to-charge ratios of a sample to be analyzed. By changing the voltage to the entrance end cap electrode from the second DC voltage described above to the zero or near-zero voltage at such timing, the energy of ions existing in the ion trap space is decreased, and the ions from smaller mass-to-charge ratios to larger mass-to-charge ratios can be trapped there assuredly.

The ion trapping device of the present invention does not waste ions of a sample and can trap most of the ions that have entered the ion trap space. Such an ion trap device can provide more ions to the detector or to a subsequent analyzer, so that the sensitivity and precision of the analysis are improved. Since ions of smaller mass-to-charge ratios surely stays in the ion trap space until ions of larger mass-to-charge ratios introduced into the ion trap join them, the range of mass-to-charge ratio of the ions in the ion trap space is enlarged. This allows an analysis of a wider range of samples.

DESCRIPTION OF A PREFERRED EMBODIMENT

Figure 1:
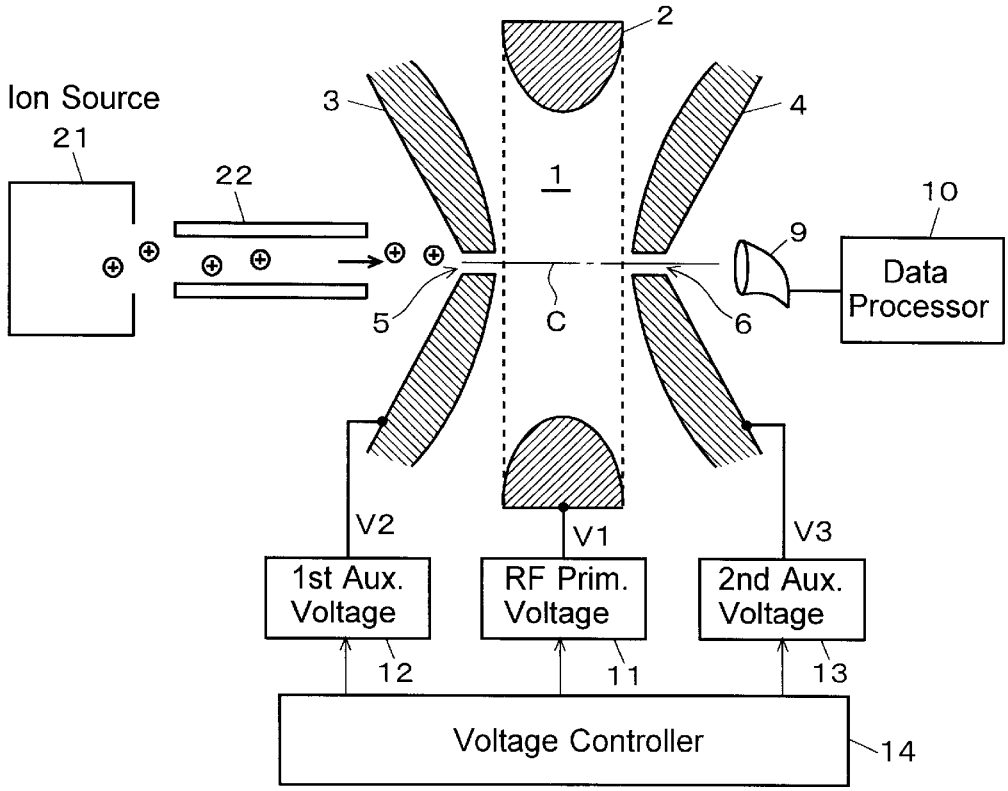
FIG. 1 is a sectional view of an ion trap mass spectrometer embodying the present invention.
Figure 2:
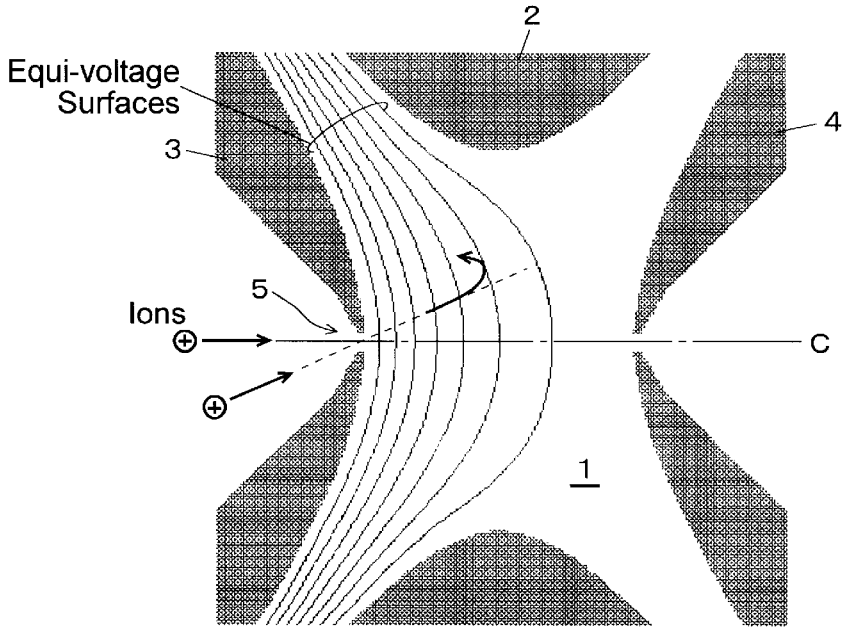
FIG. 2 illustrates the static electric field when ions are introduced in the ion trap space of the mass spectrometer of the above embodiment.
Figure 3:
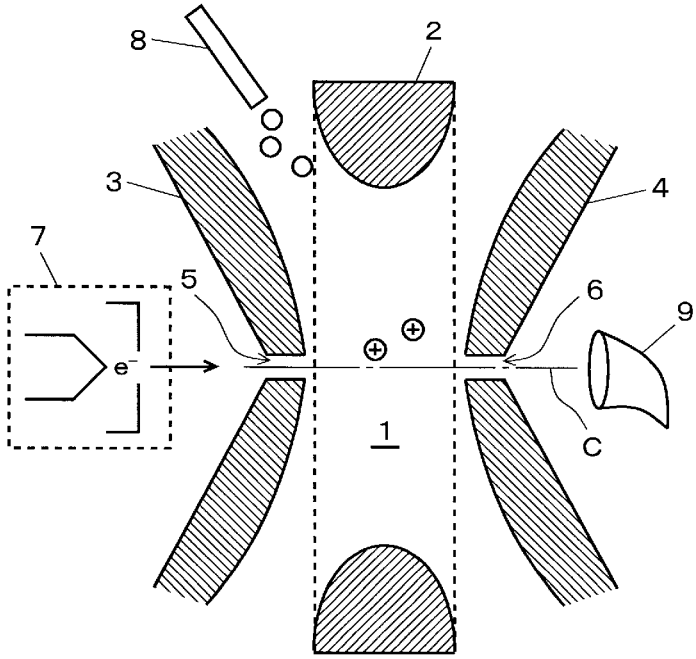
FIG. 3 is a sectional view of a normal ion trap mass spectrometer.
Figure 4:
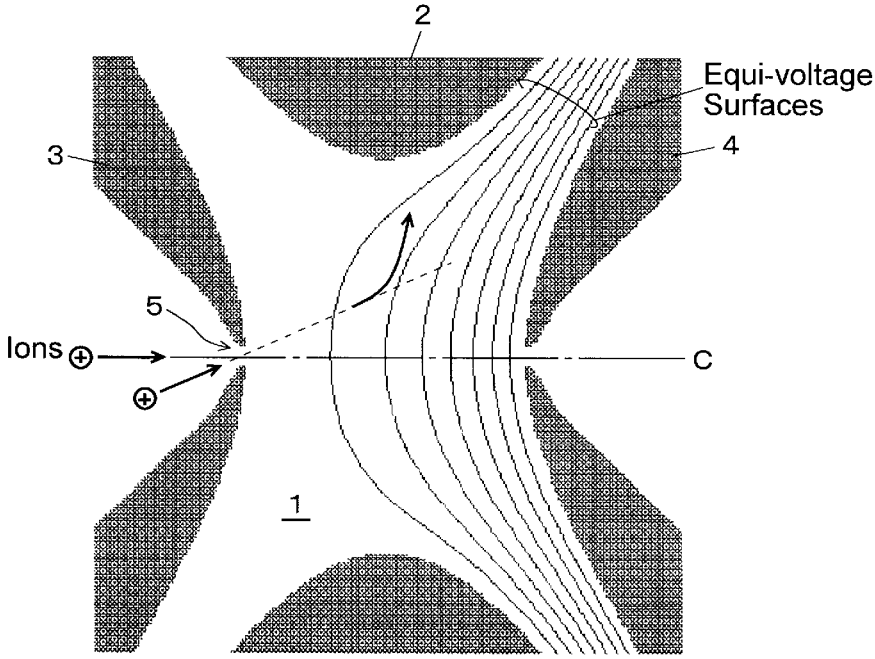
Fig. 4 PRIOR ART
FIG. 4 illustrates the static electric field when ions are introduced in the ion trap space of the prior configuration of mass spectrometer.

An ion trap mass spectrometer using an ion trapping device embodying the present invention is described referring to FIGS. 1 and 2. FIG. 1 uses the same numerals for the same elements as in FIG. 1, so that the above description may be referred to when necessary.

In the ion source 21 placed outside of the ion trap space 1, sample molecules are ionized. The ion source 21 may use any ionizing method. For example, a liquid sample is ionized by the Atmospheric Ionization method in which the liquid sample is sprayed in the atmosphere and ions are produced from the mist. The ions produced in the ion source 21 are transported through the ion guide (or ion lens) 22 to the entrance hole 5 of the entrance end cap electrode 3. The ion guide 22 may also take any form if it conveys as many ions as possible to the entrance hole 5. For example, instead of the rod type as shown in FIG. 1, it can be composed of a plurality of ring plates arranged along the ion path.

The RF primary voltage generator 11 is connected to the ring electrode 2, and the first and second auxiliary voltage generators 12 and 13 are connected to the end cap electrodes 3 and 4 to apply respective voltages to them independently. These voltage generators 11, 12 and 13 are controlled by the voltage controller 14.

In the mass spectrometer of the present embodiment, ions produced in the external ion source 21 are introduced through the entrance hole 5 into the ion trap space 1 and are trapped there for some time. Then some of the ions are ejected through the exit hole 6 from the ion trap space 1, and the ejected ions are detected by the ion detector. The mass-to-charge ratio of the ions can be measured in various ways. One is to eject ions in the order of the mass-to-charge ratio by continuously changing the RF voltage. Alternatively, ions ejected from the ion trap space can be simultaneously separated by a Time-of-Flight (TOF) mass spectrometer.

The voltage control when ions are introduced in the ion trap space 1 is described. When positive ions are to be introduced, the voltage controller 14 sends commands to the primary RF voltage generator 11 and the second auxiliary voltage generator 13 to set the voltages V1 and V3 to the ring electrode 2 and the exit end cap electrode 4, respectively, at zero, and sends a command to the first auxiliary voltage generator 12 to set the voltage V2 to the entrance end cap electrode 3 at −4V. Owing to such a configuration of voltage applications, no electric field is produced in the space between the ring electrode 2 and the exit end cap electrode 4 because they are at the same voltage. Thus, the voltage present at the entrance end cap electrode 3 forms the equi-voltage surfaces as shown in FIG. 2 which are concave to the incoming ions. FIG. 2 is also drawn by computer simulation. The equi-voltage surfaces surround and decelerate the ions coming through the entrance hole 5. The value of the voltages to the electrodes 2, 3 and 4 may be set otherwise, as long as an electric field of a similar shape surrounding the entrance hole 5 can be produced.

With such a static electric field, the ions coming substantially along the axis C cross the equi-voltage surfaces perpendicularly and are adequately decelerated, so that they are finally trapped in the ion trap space 1. The ions coming obliquely to the axis C also cross the equi-voltage surfaces near perpendicularly. Thus the decelerating effect of the static electric field is quite efficient, and the energy is suppressed when the voltage V2 to the entrance end cap electrode 3 is changed from −4V to 0V. Even if the ions are reflected by the equi-voltage surfaces, the time until they collide with the ring electrode 2 is elongated. This allows ions of relatively larger mass-to-charge ratios to certainly come to the ion trap space 1, which broadens the range of mass-to-charge ratio trapped by the ion trap mass spectrometer.

That is, among various ions (ions having various mass-to-charge ratios) produced in the ion source 21, lightweight ions enter the ion trap space 1 earlier than heavier ions, and the lightweight ions experience the static electric field described above. While lightweight ions are decelerated and reflected by the static electric field and trapped in the ion trap space 1, the heavier ions arrive at the entrance hole 5 and enter the ion trap space 1. By adequately decelerating even obliquely entering lightweight ions, as described before, enough time can be secured until heavier ions come into the ion trap space 1. At the timing when ions of a preset largest mass-to-charge ratios are assumed to enter the ion trap space 1, an RF primary voltage of $V_0 \cos \omega t$ is applied to the ring electrode 2. Owing to the voltage, a quadrupole electric field is produced in the ion trap space 1 for trapping the ions. The ions present at that time in the ion trap space 1 are trapped there and do not escape outside. At about the same time as the application of the RF primary voltage, the voltage V2 to the entrance end cap electrode 3 is changed to the ground voltage to decrease the energy of ions. This further enhances the ion trapping efficiency. Thus, according to the present invention, more ions can be assuredly trapped in the ion trap space 1. Such ions are, of course, usable in a subsequent mass separation or other ion analysis.

In the above description, ions are supposed to be positive. It is of course obvious for the practitioners in this field that the same device can be used for negative ions if the polarity of the voltages is properly modified. It is also apparent that several variations can be made within the scope of the present invention.

What is claimed is:

1. An ion trapping device comprising:

a ring electrode;

an entrance end cap electrode and an exit end cap electrode placed opposite each other with the ring electrode therebetween, forming an ion trap space surrounded by the ring electrode, the entrance end cap electrode and the exit end cap electrode, the entrance end cap electrode having an entrance hole for introducing ions from outside to the ion trap space; and a voltage controller for applying preset respective voltages to the ring electrode, the entrance end cap electrode and the exit end cap electrode to form equi-voltage surfaces concave to the entrance hole in the ion trap space.

2. The ion trapping device according to claim 1, wherein the voltage controller applies a same first direct current (DC) voltage to the ring electrode and the exit end cap electrode, and applies a second DC voltage which is lower than the first DC voltage if the ions are positive, or is higher than the first DC voltage if the ions are negative, to the entrance end cap electrode.

3. The ion trapping device according to claim 1, wherein the voltage controller applies the second DC voltage to the entrance end cap electrode while ions are being introduced in the ion trap space, and, subsequently at a predetermined timing, changes the voltage to the entrance end cap electrode to a zero or near-zero voltage.

4. The ion trapping device according to claim 3, wherein the timing is predetermined so that ions of a preset largest mass-to-charge ratio are assumed to enter the ion trap space.

5. A method of trapping ions in an ion trapping device comprising:

a ring electrode; and an entrance end cap electrode and an exit end cap electrode placed opposite each other with the ring electrode therebetween, forming an ion trap space surrounded by the ring electrode, the entrance end cap electrode and the exit end cap electrode, the entrance end cap electrode having an entrance hole for admitting ions from outside to the ion trap space, wherein preset respective voltages are applied to the ring electrode, the entrance end cap electrode and the exit end cap electrode to form equi-voltage surfaces concave to the entrance hole in the ion trap space.

6. The ion trapping method according to claim 5, wherein a same first direct current (DC) voltage is applied to the ring electrode and the exit end cap electrode, and a second DC voltage which is lower than the first DC voltage if the ions are positive, or is higher than the first DC voltage if the ions are negative, is applied to the entrance end cap electrode.

7. The ion trapping method according to claim 5, wherein the second DC voltage is applied to the entrance end cap electrode while ions are being introduced in the ion trap space, and, subsequently at a predetermined timing, the voltage to the entrance end cap electrode is changed to a zero or near-zero voltage.

8. The ion trapping method according to claim 7, wherein the timing is predetermined so that ions of a preset largest mass-to-charge ratio are assumed to enter the ion trap space.

* * * * *